United States Patent [19]

Busch et al.

[11] Patent Number: 5,076,298

[45] Date of Patent: Dec. 31, 1991

[54] DISPENSER FOR MULTICOMPONENT HAIR-COSMETIC PRODUCTS

[75] Inventors: Peter Busch, Erkrath; Klaus Thiele, Langenfeld, both of Fed. Rep. of Germany

[73] Assignee: Henkel Kommanditgesellschaft auf Aktien, Duesseldorf, Fed. Rep. of Germany

[21] Appl. No.: 238,025

[22] Filed: Aug. 29, 1988

[30] Foreign Application Priority Data

Aug. 29, 1987 [DE] Fed. Rep. of Germany ..... 3728876

[51] Int. Cl.[5] ..... A45D 24/16

[52] U.S. Cl. ..... 132/109; 401/283; 401/44; 401/47; 132/108

[58] Field of Search ..... 401/283, 44, 47; 132/108, 109, 110, 112, 113, 114

[56] References Cited

U.S. PATENT DOCUMENTS

| | | | |
|---|---|---|---|
| 1,645,038 | 10/1927 | Borer | 132/116 |
| 2,225,282 | 12/1940 | Taborski | 132/114 |
| 2,446,398 | 8/1948 | Wilson | 132/116 |
| 2,604,102 | 7/1952 | Laing | 132/110 |
| 2,819,723 | 1/1958 | Meyer | 132/116 |
| 4,585,018 | 4/1986 | O'Connor | 132/120 |
| 4,867,183 | 9/1989 | Busch et al. | 132/110 |

FOREIGN PATENT DOCUMENTS

| | | | |
|---|---|---|---|
| 0509192 | 1/1955 | Canada | 132/112 |
| 2163878 | 12/1971 | Fed. Rep. of Germany . | |
| 2824525 | 6/1978 | Fed. Rep. of Germany . | |
| 3029691 | 2/1982 | Fed. Rep. of Germany . | |
| 3622234 | 1/1988 | Fed. Rep. of Germany . | |

*Primary Examiner*—Gene Mancene
*Assistant Examiner*—Adriene B. Lepiane
*Attorney, Agent, or Firm*—Ernest G. Szoke; Wayne C. Jaeschke; Kenneth Watov

[57] ABSTRACT

A dispenser for multicomponent hair-cosmetic products, such as hair-dyeing preparations, includes in one embodiment a tubular element including absorbent material in separate storage compartments for each product component, respectively, and a plurality of tines of absorbent material partially inserted into the storage compartments for transferring the components by capillary action from the storage compartments into the tines, where the components are mixed and immediately thereafter available for transfer from the tines to hair to be dyed.

9 Claims, 5 Drawing Sheets

DISPENSER FOR MULTICOMPONENT HAIR-COSMETIC PRODUCTS

BACKGROUND

1. Field of the Invention

This invention generally relates to dispensers for multicomponent hair-cosmetic products, and more particularly to dispensers for hair-dyeing preparations permitting application of the preparation directly to hair.

2. Discussion of Related Art

One of Applicants' earlier, as yet unpublished patent applications describes a dispenser for hair-cosmetic products, more especially a hair dye applicator in the form of a comb or brush with a hollow back accommodating a treatment preparation and, inserted therein tines of an absorbent material communicating with the liquid treatment preparation by capillary action. Unlike conventional dispensers, this dispenser provides for the supply of liquid treatment preparations in direct dependence upon the quantity of treatment preparation applied to the hair. The treatment preparation, for example hair dye, is uniformly applied to the hair. However, the disadvantage is that the treatment preparation, which generally consists of several components, has to be mixed before application, i.e. before introduction into the dispenser. As a result, possible mixing effects or reactions actually occur before the product is applied, so that the effect of the product may be impaired.

SUMMARY OF THE INVENTION

Accordingly, an object of the present invention is to provide a new dispenser which enables the components of a hair-cosmetic product to be blended with one another immediately before application.

According to the invention, this object is achieved by providing a dispenser including a tubular element provided with at least two storage compartments for separately accommodating the individual components of the product. The two components are brought together in the tines of the dispenser immediately before application. To this end, the components are first stored separately from one another in at least two storage compartments communicating with the tines by capillary action. The individual components thus pass from the compartments into the tines and are mixed therein.

In another embodiment of the invention, the compartments consist of at least two small suction tubes each designed for insertion into the tubular element, in a manner separately accommodating the components of the product, while permitting the components to communicate with the common tines. In this embodiment, depending on the number of components of the hair-cosmetic product, a corresponding number of suction tubes impregnated with the individual components are inserted into the tubular element.

According to another embodiment of the invention, at least one of the compartments is formed by a suction tube and at least one other compartment is formed by a cartridge communicating with the suction tube, the contents of the cartridge being intended for introduction into the suction tube. This embodiment is suitable for products of which the components can be or have to be combined with one another shortly before application.

In another embodiment of the invention, the compartments are at least partly formed by a cartridge enclosed in a sleeve designed to be pushed over the tubular element and which communicates with a filling material acting as a reservoir in the tubular element. The individual components temporarily stored in the cartridges are introduced in the required quantities into the reservoir in the tubular element in which they are then mixed.

In a preferred embodiment of the invention, a mixing chamber is arranged between the cartridges and the filling material. The mixing chamber provides for relatively better mixing of the individual components.

In another embodiment of the invention, the compartments are formed by two containers interconnected by a membrane which are enclosed in a sleeve designed to be pushed or slid tightly over the tubular element, with one of the containers communicating with a filling material acting as reservoir in the tubular element.

In a particularly practical and preferred embodiment of the invention, the suction tubes and/or the filling material consist of sponges or tampons. These materials are particularly suitable for absorbing and storing the liquid products.

BRIEF DESCRIPTION OF THE DRAWINGS

Embodiments of the invention are described by way of example in the following with reference to the accompanying drawings, in which like items are identified by the same reference number, wherein.

DETAILED DESCRIPTION OF THE INVENTION

Figure 1A:
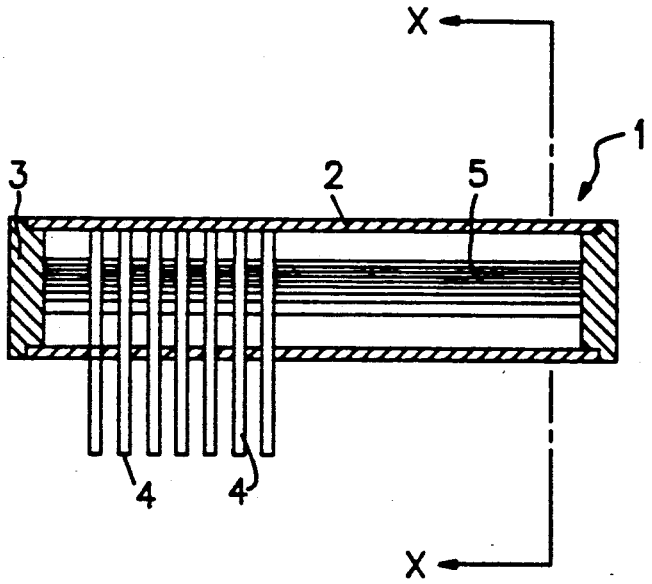
FIG. 1A is a longitudinal sectional view through an embodiment for a two-component product.
Figure 1B:
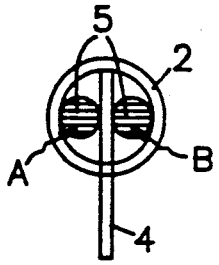
FIG. 1B is cross-sectional view X—X of the embodiment of FIG. 1A.

FIGS. 1A and 1B show a dispenser 1 comprising a tubular element 2 with stoppers 3. Wick-like tines 4 communicate with small suction tubes 5 in the tubular element 2. The suction tubes 5 comprise a liquid absorbing material. This embodiment is suitable for two-component hair-dyeing preparations. The two components (dye precursor A and oxidizing agent B) are stored separately from one another in the two juxtaposed suction tubes 5. Through capillary action both components A and B enter the wick-like tines 4 where they are mixed. The dispenser 1, which is designed to be used like a comb, is applied with the tines 4 to the strands of hair to be dyed. After the hair-dyeing preparation has been used up, fresh product is brought up from the two suction tubes 5 by the capillary action of the tines 4. Through mixing of the two components A and B of the hair-dyeing preparation in the tines 4 immediately before application of the preparation, the hair-dyeing preparation develops its full effect.

The embodiments shown by way of example in FIGS. 2A and 2B through FIG. 6 are provided with the same reference numerals as in FIG. 1, plus an additional alphabetical index where the same elements occur.

Figure 2A:
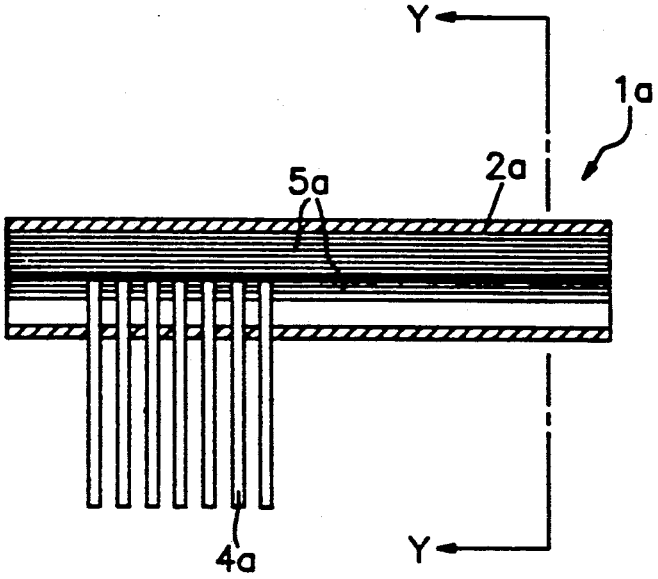
FIG. 2A is a longitudinal sectional view through an embodiment of FIG. 2A.
Figure 2B:
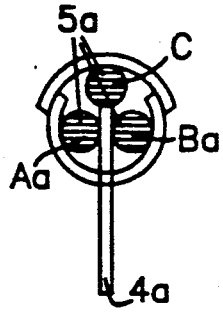
FIG. 2B is a cross-sectional view Y—Y of the embodiment of FIG. 2A.

FIGS. 2A and 2B show an embodiment for a three-component hair-dyeing preparation. This embodiment functions on the same principle as the embodiment shown in FIG. 1 Three components Aa, Ba and C (for example two dye precursors Aa, Ba and an oxidizing agent (C)) are distributed separately from one another among three suction tubes 5*a*, respectively The components Aa, Ba and C are mixed in the wick-like tines 4.

Figure 3:
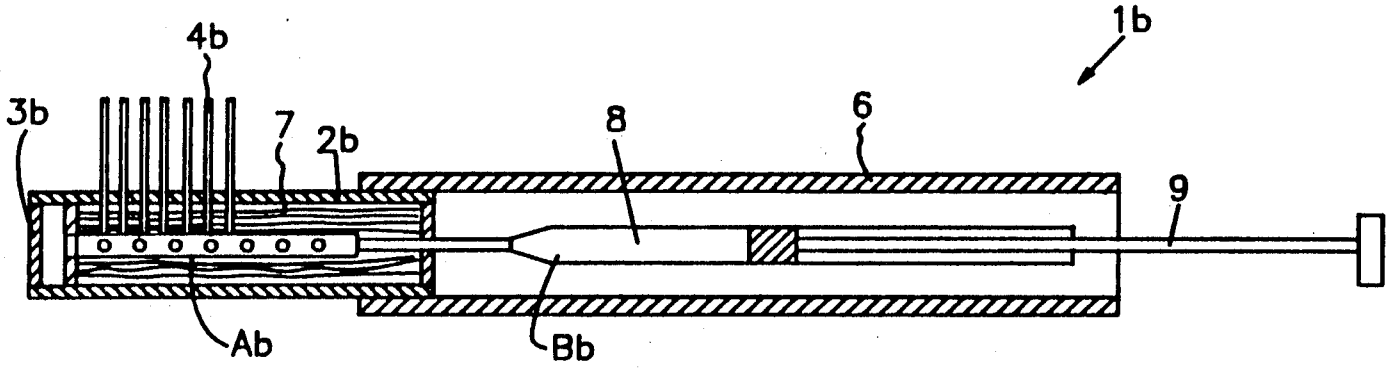
FIG. 3 is a longitudinal sectional view through another embodiment for a two-component product.

FIG. 3 shows another embodiment of the invention for a two-component hair-dyeing preparation. One of the components Ab (dye precursor) is stored in a filling material 7 which acts as a reservoir, and which is arranged in the tubular element 2*b*, as shown. The second component Bb (oxidizing agent) is accommodated in a spray cartridge 8 with a plunger 9 arranged in a sleeve 6. In the practical application of the dispenser 1*b*, a predetermined quantity of oxidizing agent Bb is introduced from the cartridge 8 into the filling material 7 by depression of the plunger 9, so that mixture of dye precursor Ab and oxidizing agent Bb is formed therein. This mixture passes from the filling material 7 into the tines 4*b*. Such mixing shortly before application of the product is preferred for certain hair-dyeing preparations.

Figure 4A:
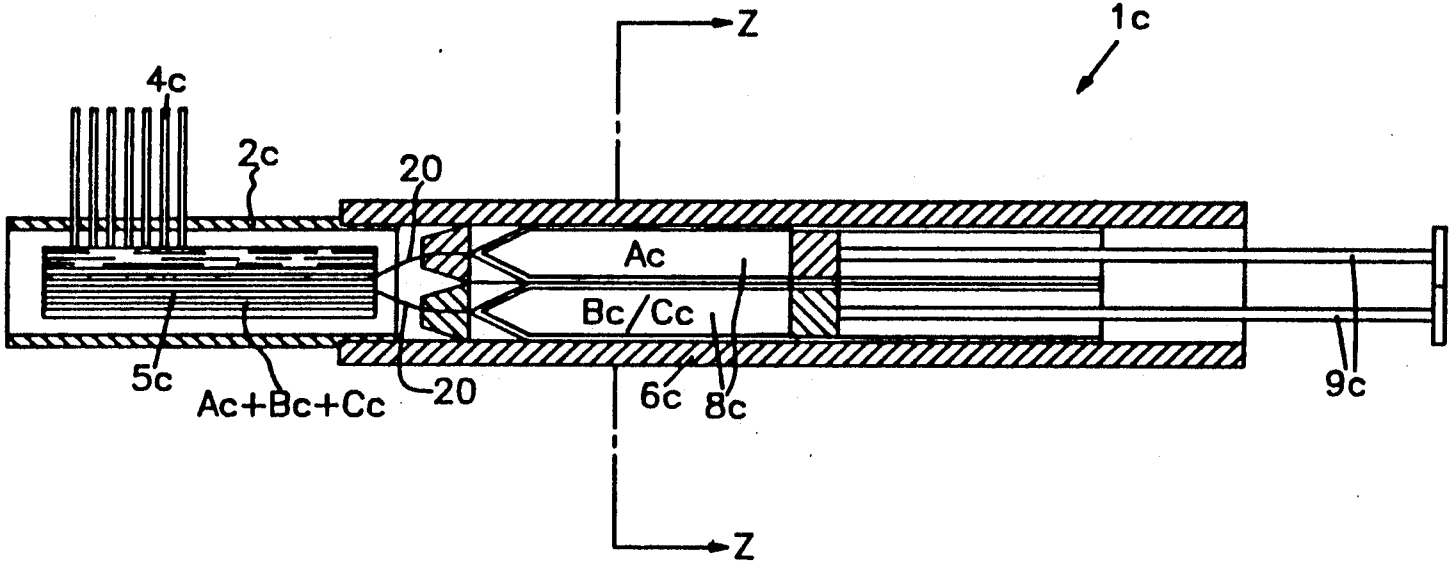
FIG. 4A is a longitudinal sectional view through another embodiment for a three-component product.
Figure 4B:
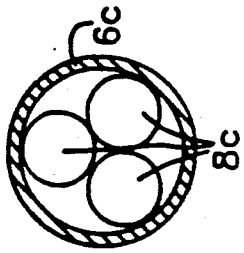
FIG. 4B is a cross-sectional view Z—Z of the embodiment of FIG. 4A.

FIGS. 4A and 4B show another embodiment of the invention for a three-component hair-dyeing preparation. The dye precursors Ac (for example ammonium salt) and Bc (for example ammoniale) and the oxidizing agent Cc are accommodated in three spray cartridges 8*c* each with a plunger 9*c*. Before application, the plungers 9*c* are depressed so that the components Ac, Bc and Cc flow through delivery tubes 20, enter the suction tube 5*c* in the tubular element 2*c*, and are mixed within tube 5*c*. The hair-dyeing process then takes place via delivery of the mixture through the corresponding tines 4*c*.

Figure 5:
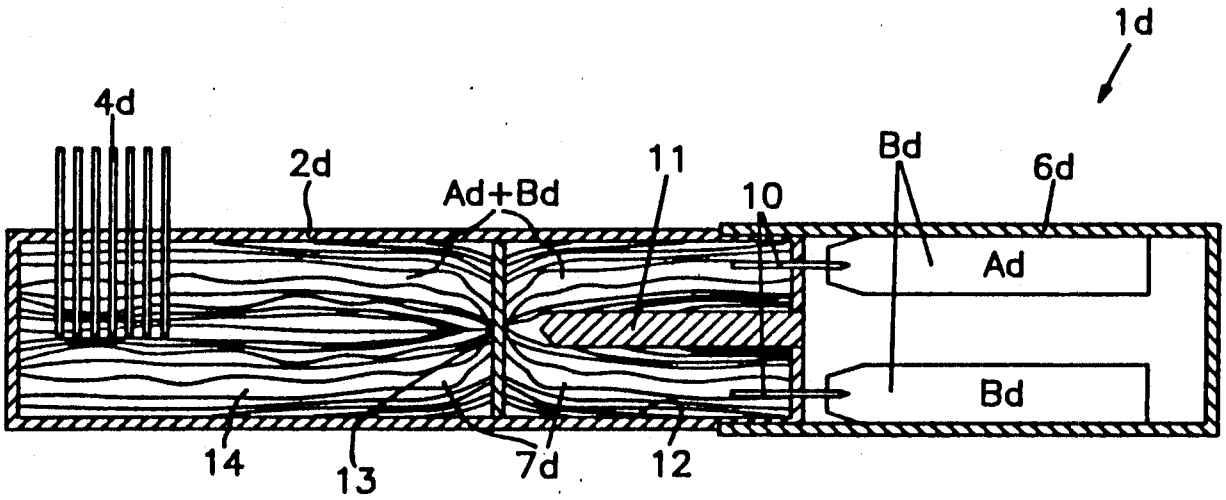
FIG. 5 is a longitudinal sectional view through another embodiment for a two-component product.

FIG. 5 shows another embodiment of the invention for a two-component hair-dyeing preparation. A dye precursor Ad and an oxidizing agent Bd are separately accommodated or stored in two cartridges 8*d*, respectively. The cartridges 8*d* open via tubular spikes 10 into a mixing chamber 12 which is divided by a partition 11, and filled with filling material 7*d*. By capillary action, the components Ad and Bd are conducted through an opening 13 into the actual storage compartment 14. The hair-dyeing preparation is completely mixed in the compartment 14. The hair-dyeing preparation then flows out of compartment 14 through the tines 4*d*.

Figure 6:
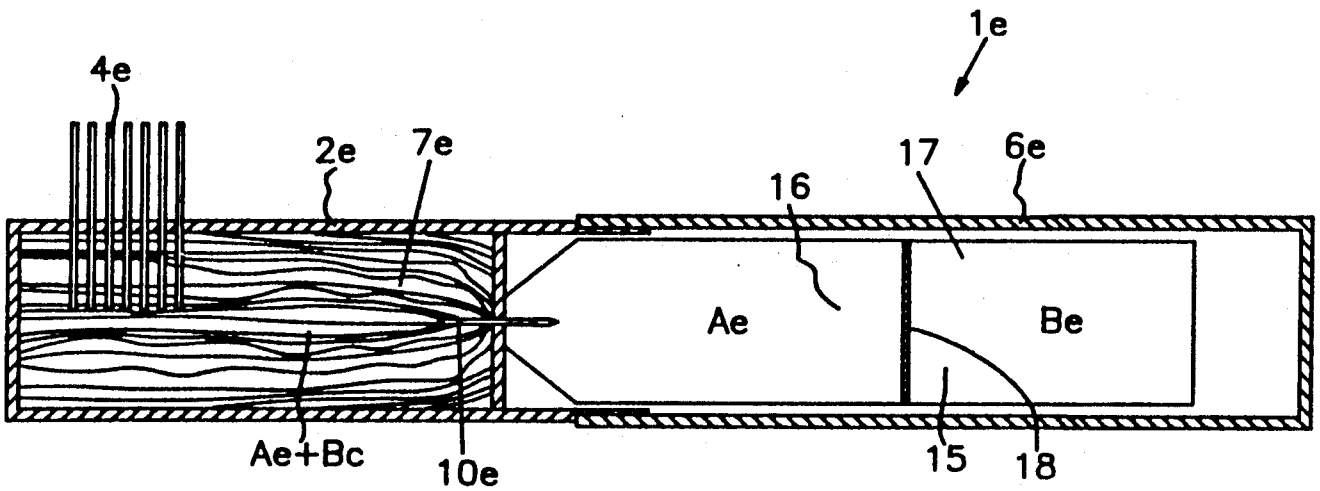
FIG. 6 is a longitudinal sectional view through another embodiment for a two-component product.

FIG. 6 shows another embodiment for a two-component hair-dyeing preparation. The dye precursor Ae and the oxidizing agent Be are stored separately from one another in a vial 15 situated in the sleeve 6*e*. The dye precursor Ae is accommodated or stored in compartment 16, while the oxidizing agent Be is accommodated or stored in a compartment 17, which are separated from one another by a membrane 18, for example. The oxidizing agent Be passes from the compartment 17 through the membrane 18 into the compartment 16, where it mixes with the dye precursor Ae. The mixed product passes through the tubular spike 10*e* into the chamber portion of the tubular element 2*e* which is filled with filling material 7*e*. The hair-dyeing preparation is then applied to the hair through the tines 4*e*.

To prevent application of the hair-dyeing preparation to the scalp of the person being treated, the tips of the tines globally denoted by the reference 4 are sealed by heating or ultrasound. The hair dyeing preparation flows out of openings (not shown) along a portion of the length of the tines 4.

The invention is not limited to the examples of embodiment shown in the drawings for purposes of illustration. Other embodiments of the invention covered by the spirit and scope of the appended claims may be apparent to one of skill in the art. Such embodiments may include more than two or three components, for example. Moreover, it is apparent that the dispenser can be employed for a wide variety of liquids. For example, we can employ solutions or emulsions which, for example, contain pyrethrum, nicotine or chlorinated hydrocarbons and which are used for disinfecting treatment of head lice and for the treatment of parasites on or in the skins of animals.

We claim:

1. A dispenser for multicomponent hair-cosmetic products, comprising:

a tubular-like housing element for receiving therein both a treatment preparation; and tines of an absorbent material which communicate with the treatment preparation by capillary action, said housing element including at least two storage compartments each consisting of liquid absorbing material for separately accommodating first and second components of said treatment preparation, respectively, and communicating these components to one end portion of said tines via capillary action, the components being mixed in said tines, the other ends of said tines serving to dispense the mixture as needed.

2. The dispenser of claim 1, wherein said compartments each are separated from one another via the one ends of said tines.

3. The dispenser of claim 1, wherein said storage compartments consist of either one of sponges and tampons.

4. A dispenser for multicomponent hair-cosmetic products, comprising:

a tubular-like housing element;

first and second liquid absorbent storage means enclosed within said housing element for receiving first and second components of a liquid hair treatment preparation, respectively;

a plurality of tines of an absorbent material each having a portion of one end inserted through an outer side wall of said housing element for location therein between and separating said first and second liquid absorbent storage means, said tines each communicating with said first and second liquid storage means for absorbing via capillary action therefrom, respectively, said first and second compartments which are mixed in said tines, the other ends of said tines protruding from said housing element permitting the mixed first and second components to be dispensed therefrom to a user's hair as needed.

5. The dispenser of claim 4, wherein said first and second liquid storage compartment means each consists of an elongated tubular-like member of liquid absorbent material.

6. The dispenser of claim 5, wherein said storage means consist of sponge material.

7. The dispenser of claim 5, wherein said storage means consist of tampon-like material.

8. The dispenser of claim 4, wherein said plurality of tines are arranged at their other ends to form a comb-like configuration.

9. The dispenser of claim 4, further including a third liquid absorbent storage means enclosed within said housing element for receiving a third component of a hair treatment preparation, whereby said tines are adapted to retain said first through third storage means separate and apart, and to remove via capillary action said first through third components from their associated storage means, for mixing within said tines and dispensing therefrom as needed.

* * * * *